US012599279B2

(12) United States Patent
Pan et al.

(10) Patent No.: US 12,599,279 B2
(45) Date of Patent: Apr. 14, 2026

(54) MULTI-FUNCTIONAL DOUBLE-HEAD ELECTRIC CLEANING DEVICE

(71) Applicant: Huizhou Yunda Power Electronic Technology Co. , Ltd., Huizhou (CN)

(72) Inventors: Qishun Pan, Shaoguan (CN); Qiwei Pan, Shaoguan (CN)

(73) Assignee: Huizhou Yunda Power Electronic Technology Co. , Ltd., Huizhou (CN)

( * ) Notice: Subject to any disclaimer, the term of this patent is extended or adjusted under 35 U.S.C. 154(b) by 0 days.

(21) Appl. No.: 19/312,095

(22) Filed: Aug. 27, 2025

(65) Prior Publication Data

US 2026/0090691 A1 Apr. 2, 2026

(30) Foreign Application Priority Data

Oct. 2, 2024 (CN) ..... 202422405002.0

(51) Int. Cl.
*A47L 11/283* (2006.01)
*A47L 11/40* (2006.01)

(52) U.S. Cl.
CPC ..... *A47L 11/283* (2013.01); *A47L 11/4005* (2013.01); *A47L 11/4008* (2013.01); (Continued)

(58) Field of Classification Search
CPC ..... A47L 11/283; A47L 11/4005; A47L 11/4008; A47L 11/4069; A47L 11/4083; A47L 11/4088
See application file for complete search history.

(56) References Cited

U.S. PATENT DOCUMENTS

2019/0328202 A1* 10/2019 Yang ..... A47L 11/282
2022/0338703 A1* 10/2022 Ahmed ..... A47L 11/4038
2025/0064286 A1* 2/2025 Johnson ..... A47L 7/0023

FOREIGN PATENT DOCUMENTS

AU 2018100223 A4 * 3/2018 ..... A47L 13/256
CN 103417165 A 12/2013
(Continued)

OTHER PUBLICATIONS

KR-20250124565-A—English Machine Translation (Year: 2025).*
(Continued)

*Primary Examiner* — Marc Carlson
(74) *Attorney, Agent, or Firm* — Nitin Kaushik

(57) ABSTRACT

Disclosed is a multi-functional double-head electric cleaning device, including: a power assembly including a housing; and a circuit board, a driving mechanism, and a water pump that are disposed in the housing respectively, where the driving mechanism penetrates through the housing; a water tank assembly detachably disposed on the housing and communicated with the water pump; a connecting rod assembly rotatably disposed on the housing; two cleaning assemblies detachably connected to the corresponding driving mechanism respectively; a battery assembly detachably connected to the connecting rod assembly and electrically connected to the power assembly; and a key assembly disposed on the connecting rod assembly in a penetrating manner and electrically connected to the power assembly. In this disclosure, two different types of cleaning assemblies are detachably disposed on the driving mechanism, and the water pump is matched with the water tank assembly to spray cleaning liquid.

13 Claims, 10 Drawing Sheets

(52) U.S. Cl.
CPC ..... *A47L 11/4069* (2013.01); *A47L 11/4083* (2013.01); *A47L 11/4088* (2013.01)

(56) References Cited

FOREIGN PATENT DOCUMENTS

| | | | | | |
|---|---|---|---|---|---|
| CN | 106798531 | A | * | 6/2017 | ..... B60S 3/04 |
| CN | 112530726 | A | * | 3/2021 | ..... H01H 13/12 |
| CN | 112716391 | A | * | 4/2021 | ..... A47L 11/282 |
| CN | 112956967 | A | * | 6/2021 | ..... A47L 11/282 |
| CN | 214906468 | U | * | 11/2021 | |
| CN | 113854898 | A | * | 12/2021 | ..... A47L 9/0405 |
| CN | 113854899 | A | * | 12/2021 | ..... A47L 9/0411 |
| CN | 114451823 | A | * | 5/2022 | ..... A47L 11/4075 |
| CN | 114795002 | A | * | 7/2022 | ..... A47L 11/282 |
| CN | 217510414 | U | | 9/2022 | |
| CN | 218074815 | U | | 12/2022 | |
| CN | 117941987 | A | * | 4/2024 | ..... A47L 11/4088 |
| DE | 202024106600 | U1 | * | 12/2024 | ..... A47L 11/4083 |
| DE | 102024103715 | A1 | * | 8/2025 | ..... A47L 11/405 |
| EP | 3440982 | B1 | * | 10/2025 | ..... A47L 11/4083 |
| KR | 20200084213 | A | * | 7/2020 | ..... A47L 9/0411 |
| KR | 102247187 | B1 | * | 4/2021 | ..... C02F 1/467 |
| KR | 20220018673 | A | * | 2/2022 | ..... A47L 11/4005 |
| KR | 20230087858 | A | * | 6/2023 | ..... A47L 11/4088 |
| KR | 20240136272 | A | * | 9/2024 | ..... A47L 11/4069 |
| KR | 20250124565 | A | * | 8/2025 | ..... A47L 11/4038 |
| WO | WO-2020027524 | A1 | * | 2/2020 | ..... A47L 11/4088 |
| WO | WO-2022002076 | A1 | * | 1/2022 | ..... A47L 11/4052 |

OTHER PUBLICATIONS

CN-112716391-A—English Machine Translation (Year: 2021).*
WO-2020027524-A1—English Machine Translation (Year: 2020).*
EP-3440982-B1—English Machine Translation (Year: 2025).*

* cited by examiner

MULTI-FUNCTIONAL DOUBLE-HEAD ELECTRIC CLEANING DEVICE

CROSS-REFERENCE TO RELATED APPLICATIONS

The application claims priority to Chinese patent application No. 2024224050020, filed on Oct. 2, 2024, the entire contents of which are incorporated herein by reference.

TECHNICAL FIELD

This disclosure relates to the technical field of cleaning tools, and in particular, to a multi-functional double-head electric cleaning device.

BACKGROUND

When scrubbing walls, swimming pools, or floors, users need to adjust the angle of inclination between the cleaning head and the handle at different positions for more convenient use. In addition, a single cleaning head has a small cleaning area and low cleaning efficiency.

A disclosure with application No. CN219720038U provides a double-head electric cleaning brush with a lengthened rod, including a telescopic rod, and a connecting portion and an electric cleaning brush body that are disposed at one end of the telescopic rod. The electric cleaning brush body includes a housing and two brush heads. A hinge portion is disposed at one end of the housing, and the hinge portion is hinged at one end, away from the telescopic rod, of the connecting portion. A square hole is formed in the center of the hinge portion, a sliding block is slidably connected in the square hole, a disc is fixed at one end of the sliding block, and a first spring is mounted between the sliding block and the hinge portion. According to the double-head electric cleaning brush with a lengthened rod, four-angle adjustments can be performed between 90 degrees and 180 degrees through the hinge portion and the connecting portion, meeting practical requirements for different angles. Adaptive adjustments can be performed according to the actual needed length through multi-stage adjustments of the telescopic rod. The two cleaning brushes in the above solution are fixedly disposed and can only perform scrubbing operations, which have a single function and cannot meet the various cleaning requirements of the users. Therefore, a multi-functional double-head electric cleaning device is provided to solve the above problems.

SUMMARY

A purpose of this disclosure is to provide a multi-functional double-head electric cleaning device, so as to solve a problem of a single function of an existing electric cleaning device.

The multi-functional double-head electric cleaning device of this disclosure may be implemented through the following technical solutions:

A multi-functional double-head electric cleaning device of this disclosure includes: a power assembly, including a housing, where the housing is a hollow cavity; and a circuit board, a driving mechanism, and a water pump that are disposed in the housing respectively, where the circuit board is electrically connected to the driving mechanism and the water pump respectively, and the driving mechanism penetrates through the housing; a water tank assembly, detachably disposed on the housing and communicated with the water pump; a connecting rod assembly, rotatably disposed on the housing, where the connecting rod assembly can rotate relative to the housing; two cleaning assemblies, detachably connected to the corresponding driving mechanism respectively; a battery assembly, detachably connected to the connecting rod assembly and electrically connected to the power assembly; and a key assembly, disposed on the connecting rod assembly in a penetrating manner and electrically connected to the power assembly.

In an implementation, the cleaning assemblies include cleaning brush assemblies and mop assemblies.

In an implementation, the mop assemblies each include: a second connecting frame detachably connected to the driving mechanism in a clamped manner; and a mop main body detachably disposed below the second connecting frame.

In an implementation, the housing includes: a main housing, which is a hollow cavity with an opening at one end; and a cover plate fixedly disposed on the main housing, where the main housing and the cover plate form a closed cavity.

In an implementation, the driving mechanism includes: a motor disposed in the housing; a worm fixedly disposed on a rotating shaft of the motor; two small transmission gears disposed on two opposite sides of the worm respectively and in transmission connection with the worm respectively; two large transmission gears in engaging transmission connection with the two small transmission gears respectively; and two rotary frames fixedly connected to the two large transmission gears respectively.

In an implementation, the water tank assembly is provided with a liquid injection opening, and a sealing cover is detachably disposed on the liquid injection opening; and a bottom of the water tank assembly is provided with a liquid outlet nozzle, and the liquid outlet nozzle is communicated with the water pump.

In an implementation, the connecting rod assembly includes a movable rod mechanism, a telescopic rod mechanism, and a handle that are sequentially disposed, and the movable rod mechanism is rotatably disposed on the housing.

In an implementation, the movable rod mechanism includes: a connecting head fixedly disposed on the housing; a movable head rotatably disposed on the connecting head through a rotary shaft; a movable rod rotatably connected to the movable head and fixedly connected to the telescopic rod mechanism; and a clamping pin movably disposed in the movable head in a penetrating manner, which can be connected to the movable rod in a clamped manner.

In an implementation, the telescopic rod mechanism includes: a first telescopic rod fixedly connected to the movable rod; and a second telescopic rod sleeved on the first telescopic rod, which can be connected to the first telescopic rod in a clamped manner.

In an implementation, the multi-functional double-head electric cleaning device of this disclosure further includes: an illuminating mechanism and a water pump switch, electrically connected to the circuit board respectively, where the illuminating mechanism is fixedly disposed in the housing, and light emitted by the illuminating mechanism can be transmitted out of the housing; and the water pump switch sequentially penetrates through the housing and the water tank assembly.

Compared with the prior art, beneficial effects of the multi-functional double-head electric cleaning device of this disclosure are as follows:

In the multi-functional double-head electric cleaning device of this disclosure, two different types of cleaning assemblies are detachably disposed on the driving mechanism, so that a suitable cleaning assembly can be selected to perform a cleaning operation according to different requirements. The water pump is matched with the water tank assembly to spray the cleaning liquid, thereby improving the cleaning efficiency to a certain extent, implementing multiple functions of the electric cleaning device, and effectively solving the problem of the single function of the existing electric cleaning device.

In the multi-functional double-head electric cleaning device of this disclosure, by disposing double cleaning assemblies, the cleaning efficiency is greatly improved. By disposing the illuminating mechanism, the illumination operation can be performed in a cleaning environment with dim light, thereby improving the experience and satisfaction of the customer to a certain extent. Moreover, the battery assembly is detachably and electrically connected to perform the power supply operation, thereby facilitating the charging operation.

BRIEF DESCRIPTION OF THE DRAWINGS

To describe the technical solutions in the embodiments of this disclosure more clearly, the following briefly describes the accompanying drawings required for describing the embodiments. It should be understood that the following accompanying drawings show merely some embodiments of this disclosure, and therefore should not be regarded as limiting the scope. Those of ordinary skill in the art may still derive other related accompanying drawings from these accompanying drawings without creative efforts.

DETAILED DESCRIPTION OF THE EMBODIMENTS

To make the purposes, technical solutions, and advantages of the embodiments of this disclosure clearer, the following clearly and completely describes the technical solutions in the embodiments of this disclosure with reference to the accompanying drawings in the embodiments of this disclosure. Apparently, the described embodiments are some but not all of the embodiments of this disclosure. Assemblies of the embodiments of this disclosure described and shown in the accompanying drawings can be arranged and designed in various different configurations.

Therefore, the detailed description of the embodiments of this disclosure provided in the accompanying drawings is not intended to limit the claimed protection scope of this disclosure, but only to represent selected embodiments of this disclosure. Based on the embodiments in this disclosure, all other embodiments obtained by those of ordinary skill in the art without creative efforts shall fall within the protection scope of this disclosure.

First Embodiment

Figure 1:
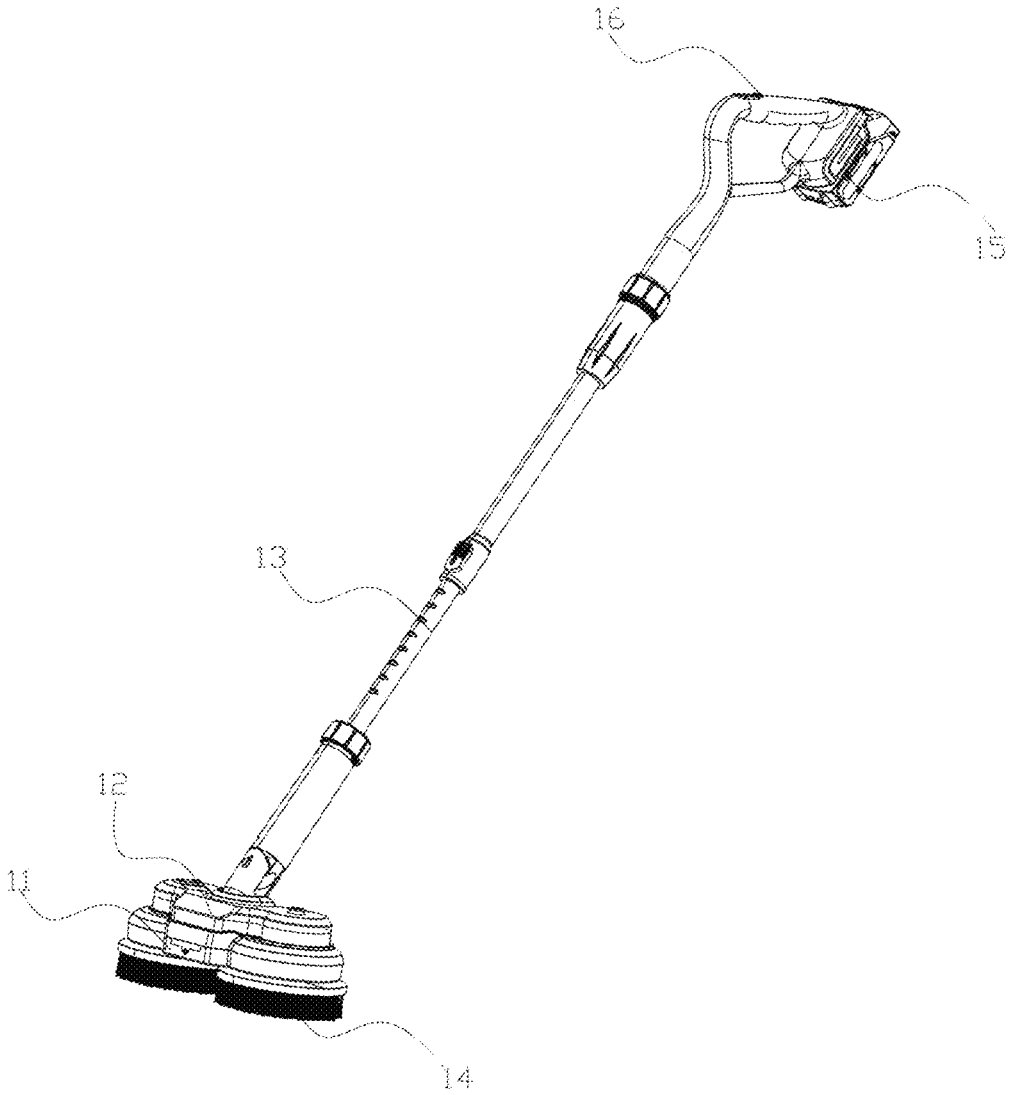
FIG. 1 is a schematic structural diagram of a first embodiment of a multi-functional double-head electric cleaning device according to this disclosure.
Figure 2:
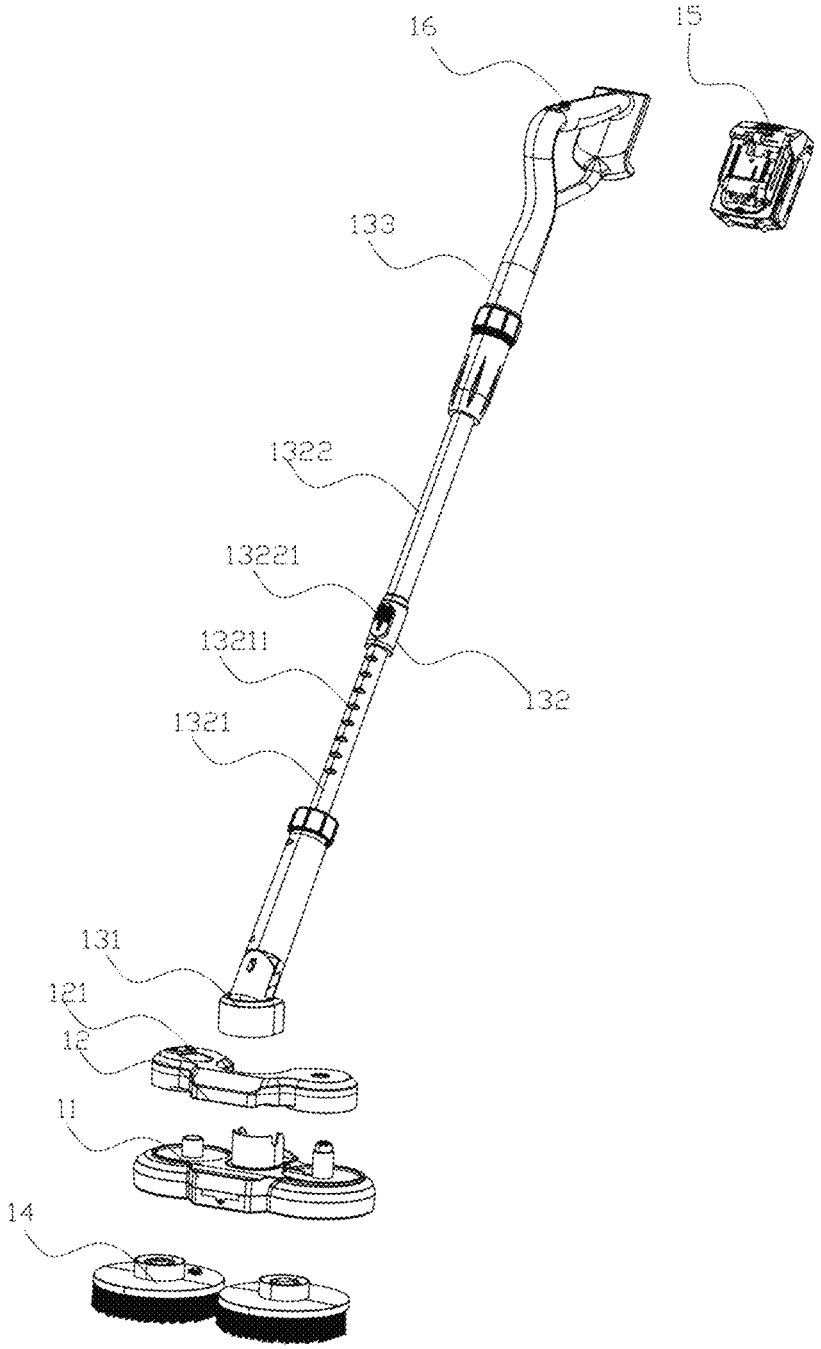
FIG. 2 is a schematic structural exploded view of a first embodiment of a multi-functional double-head electric cleaning device shown in FIG. 1 according to this disclosure, including a power assembly, a water tank assembly, a movable rod mechanism, and a cleaning brush assembly.

Referring to FIG. 1 and FIG. 2, in this embodiment, a multi-functional double-head electric cleaning device 10 of this disclosure includes a power assembly 11, a water tank assembly 12, a connecting rod assembly 13, two cleaning brush assemblies 14, a battery assembly 15, and a key assembly 16. The water tank assembly 12 is a hollow cavity and is detachably disposed on the power assembly 11, and the water tank assembly 12 stores cleaning liquid. The connecting rod assembly 13 is movably disposed on the power assembly 11 and can rotate relative to the power assembly 11, thereby facilitating the adjustments of different cleaning angles. The two cleaning brush assemblies 14 are detachably connected to the power assembly 11 respectively, and the power assembly 11 synchronously drives the two cleaning brush assemblies 14 to rotate, thereby performing scrubbing operations. The battery assembly 15 is detachably connected to the connecting rod assembly 13, is electrically connected to the power assembly 11, and serves as a power supply to the power assembly 11. The key assembly 16 is disposed on the connecting rod assembly 13 in a penetrating manner, is electrically connected to the power assembly 11, and controls switching and function settings of the power assembly 11.

Referring to FIG. 1 to FIG. 4, in this embodiment, the power assembly 11 includes a housing 111, a circuit board 112, a driving mechanism 113, a water pump 114, an illuminating mechanism 115, and a water pump switch 116. The housing 111 is a hollow cavity. The circuit board 112, the driving mechanism 113, the water pump 114, and the illuminating mechanism 115 are disposed in the housing 111 respectively, and the circuit board 112 is electrically connected to the driving mechanism 113, the water pump 114, the illuminating mechanism 115, the water pump switch 116, the battery assembly 15, and the key assembly 16 respectively. The driving mechanism 113 is disposed in the housing 111 in a penetrating manner, is in detachable transmission connection with the two cleaning brush assemblies 14 respectively, and synchronously drives the two cleaning brush assemblies 14 to rotate. The water pump 114 is communicated with the water tank assembly 12 and extracts the cleaning liquid in the water tank assembly 12 to spray onto the ground, thereby facilitating the scrubbing operations of the two cleaning brush assemblies 14. Light emitted by the illuminating mechanism 115 can be transmitted out of the housing 111, and the illuminating mechanism illuminates the scrubbing operations of the two cleaning brush assemblies 14. The water pump switch 116 sequentially penetrates through the housing 111 and the water tank assembly 12 and controls a working condition of the water pump 114.

Figure 3:
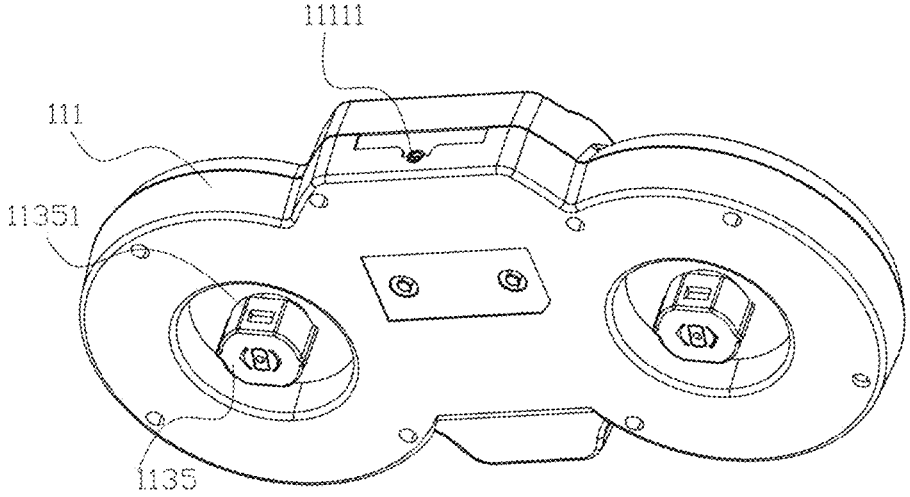
FIG. 3 is a schematic structural diagram of a power assembly shown in FIG. 2.
Figure 4:
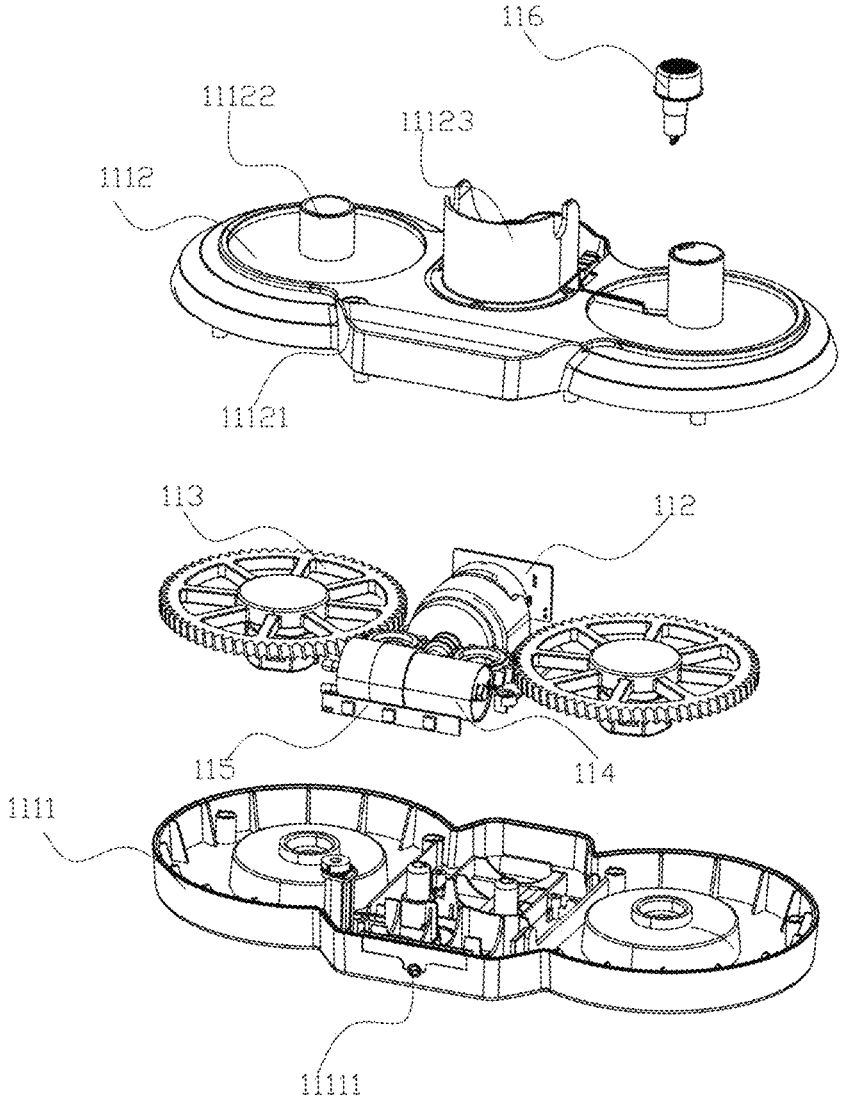
FIG. 4 is a schematic structural exploded view of a power assembly shown in FIG. 3, including a driving mechanism.

Referring to FIG. 3 and FIG. 4, in this embodiment, the housing 111 includes a main housing 1111 and a cover plate 1112. The main housing 1111 is a hollow cavity with an opening at one end, and the cover plate 1112 is fixedly disposed on the main housing 1111. The main housing and the cover plate form a closed cavity. The circuit board 112, the driving mechanism 113, the water pump 114, and the illuminating mechanism 115 are disposed in the cavity respectively. Specifically, a side edge of the main housing 1111 is provided with a liquid outlet hole 11111 in a penetrating manner, and the liquid outlet hole 11111 is communicated with a liquid outlet end of the water pump 114 through a connecting water pipe. Specifically, the cover plate 1112 is provided with a liquid inlet hole 11121 in a penetrating manner, one end of the liquid inlet hole 11121 is communicated with the water tank assembly 12 in a sealing contact manner, and the other end thereof is communicated with a liquid inlet end of the water pump 114 through the connecting water pipe. The cover plate 1112 is further provided with at least one positioning column 11122 and a connecting base 11123, the water tank assembly 12 is positioned for mounting through the at least one positioning column 11122, and the connecting rod assembly 13 is movably connected to the connecting base 11123.

Referring to FIG. 4, in this embodiment, the circuit board 112 is electrically connected to the driving mechanism 113, the water pump 114, the illuminating mechanism 115, the water pump switch 116, the battery assembly 15, and the key assembly 16 respectively, and a control technology used by the circuit board is the prior art. Therefore, a specific control process and a used model of the circuit board are not described in detail herein as long as this disclosure is satisfied.

Figure 5:
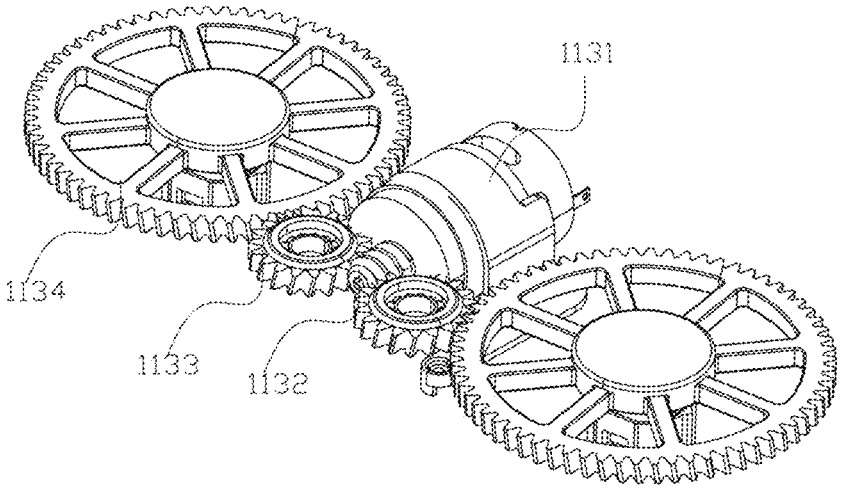
FIG. 5 is a schematic structural diagram of a driving mechanism shown in FIG. 4.

Referring to FIG. 4 and FIG. 5, in this embodiment, the driving mechanism 113 includes a motor 1131, a worm 1132, two small transmission gears 1133, two large transmission gears 1134, and two rotary frames 1135. The motor 1131 is disposed in the housing 111. The worm 1132 is fixedly disposed on a rotating shaft of the motor 1131. The two small transmission gears 1133 are disposed on two opposite sides of the worm 1132 respectively and are in transmission connection with the worm 1132 respectively. The two large transmission gears 1134 are in engaging transmission connection with the corresponding small transmission gears 1133 respectively. The two rotary frames 1135 are fixedly connected to the corresponding large transmission gears 1134 respectively and rotate with the rotation of the large transmission gears 1134, the rotary frames 1135 are provided with a plurality of clamping grooves 11351 respectively, and the cleaning brush assemblies 14 are detachably and fixedly clamped on the rotary frames 1135 through the clamping grooves 11351. The motor 1131 synchronously drives the two small transmission gears 1133 to rotate through the worm 1132 and then sequentially drives the corresponding large transmission gears 1134, the rotary frames 1135, and the cleaning brush assemblies 14 to rotate respectively through the two small transmission gears 1133. Specifically, the illuminating mechanism 115 includes a substrate and at least one LED lamp. The substrate is fixedly disposed in the housing 111 and is electrically connected to the circuit board 112. The at least one LED lamp is disposed on the substrate, and light emitted by the lamp can be transmitted out of the housing 111.

Figure 6:
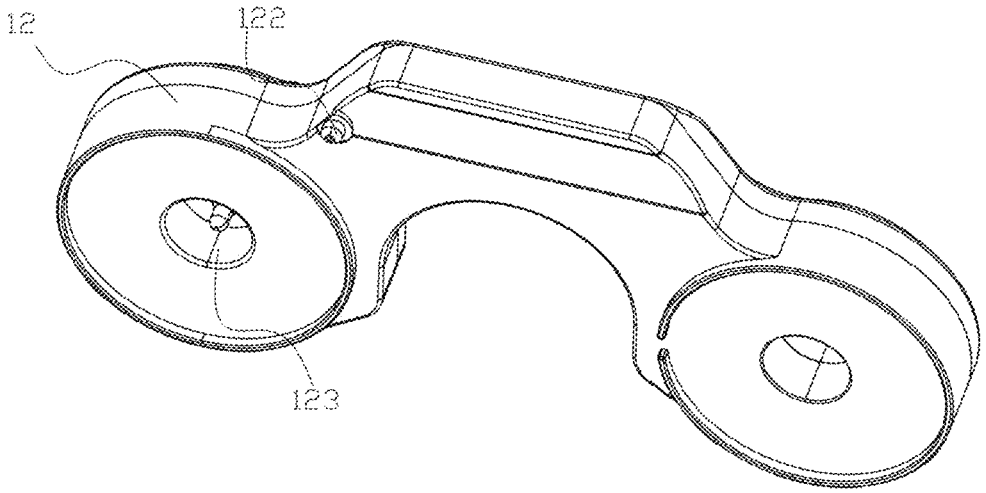
FIG. 6 is a schematic structural diagram of a water tank assembly shown in FIG. 2.

Referring to FIG. 2 and FIG. 6, in this embodiment, the water tank assembly 12 is provided with a liquid injection opening 121, a sealing cover is detachably disposed on the liquid injection opening, and the cleaning liquid is added into the water tank assembly 12 through the liquid injection opening 121. The bottom of the water tank assembly 12 is provided with a liquid outlet nozzle 122, and the cleaning liquid in the water tank assembly 12 enters the water pump 114 through the liquid outlet nozzle 122. The water tank assembly 12 is provided with at least one positioning hole 123, and the positioning hole is matched with the corresponding positioning column 11122, so that the water tank assembly 12 is detachably disposed on the housing 111 in a limited manner.

Referring to FIG. 1 and FIG. 2, in this embodiment, the connecting rod assembly 13 includes a movable rod mechanism 131, a telescopic rod mechanism 132, and a handle 133 that are sequentially disposed. The movable rod mechanism 131 is rotatably disposed on the housing 111 and can perform an angle adjustment relative to the housing 111. The battery assembly 15 is detachably disposed on the handle 133, and the key assembly 16 is disposed on the handle 133 in a penetrating manner.

Figure 7:
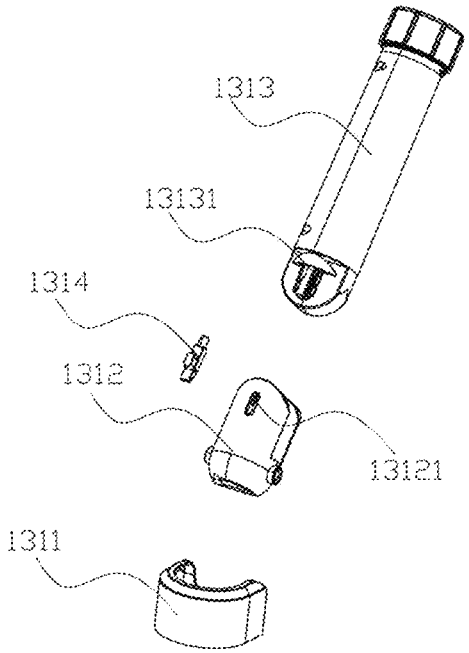
FIG. 7 is a schematic structural exploded view of a movable rod mechanism shown in FIG. 2.

Referring to FIG. 1, FIG. 2, and FIG. 7, in this embodiment, the movable rod mechanism 131 includes a connecting head 1311, a movable head 1312, a movable rod 1313, and a clamping pin 1314. The connecting head 1311 is fixedly disposed on the connecting base 11123. The movable head 1312 is rotatably disposed on the connecting head 1311 through a rotary shaft and can perform an angle adjustment relative to the connecting head 1311. The movable rod 1313 is rotatably connected to the movable head 1312 and is fixedly connected to the telescopic rod mechanism 132. The clamping pin 1314 is movably disposed in the movable head 1312 in a penetrating manner and can be connected to the movable rod 1313 in a clamped manner, and the clamping pin 1314 is connected to the movable rod 1313 in a clamped manner, so that the movable head 1312 is fixedly connected to the movable rod 1313. Specifically, the movable head 1312 is provided with a sliding groove 13121 in a penetrating manner, the clamping pin 1314 is slidably disposed in the sliding groove 13121, and the sliding groove 13121 performs a limiting and guiding operation on the movement of the clamping pin 1314. The movable rod 1313 is provided with at least one clamping hole 13131, and the clamping pin 1314 is detachably clamped in the clamping hole 13131, so that the movable head 1312 is fixedly connected to the movable rod 1313.

Referring to FIG. 1 and FIG. 2, in this embodiment, the telescopic rod mechanism 132 includes a first telescopic rod 1321 and a second telescopic rod 1322. The first telescopic rod 1321 is fixedly connected to the movable rod 1313. The second telescopic rod 1322 is sleeved on the first telescopic rod 1321 and can be connected to the first telescopic rod 1321 in a clamped manner. Specifically, a plurality of clamping strips 13211 are disposed on an outer side of the first telescopic rod 1321 respectively. A locking member 13221 is disposed on the second telescopic rod 1322, and the locking member 13221 can be connected to the plurality of clamping strips 13211 in a clamped manner respectively, thereby adjusting the length of the telescopic rod mechanism 132.

Figure 8:
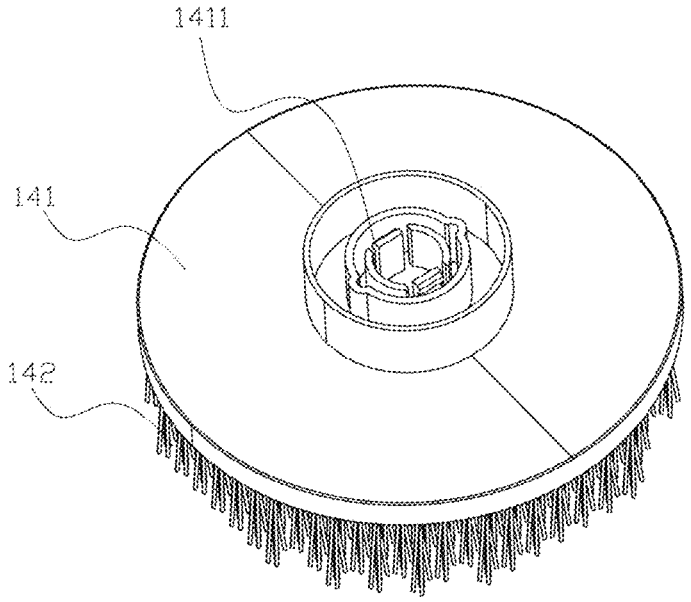
FIG. 8 is a schematic structural diagram of a cleaning brush assembly shown in FIG. 2.

Referring to FIG. 1, FIG. 2, and FIG. 8, in this embodiment, the cleaning brush assemblies 14 each include a first connecting frame 141 and a cleaning brush main body 142. The first connecting frame 141 is detachably connected to the corresponding rotary frame 1135 in a clamped manner and rotates with the rotation of the rotary frame 1135. The cleaning brush main body 142 is fixedly disposed below the first connecting frame 141, thereby implementing an automatic scrubbing operation through the rotation of the cleaning brush main body 142. Specifically, a plurality of first clamping blocks 1411 are disposed on the first connecting frame 141 respectively, and the plurality of first clamping blocks 1411 are detachably disposed in the corresponding clamping grooves 11351 in a clamped manner respectively, thereby fixedly connecting the first connecting frame 141 to the rotary frame 1135.

Second Embodiment

Figure 9:
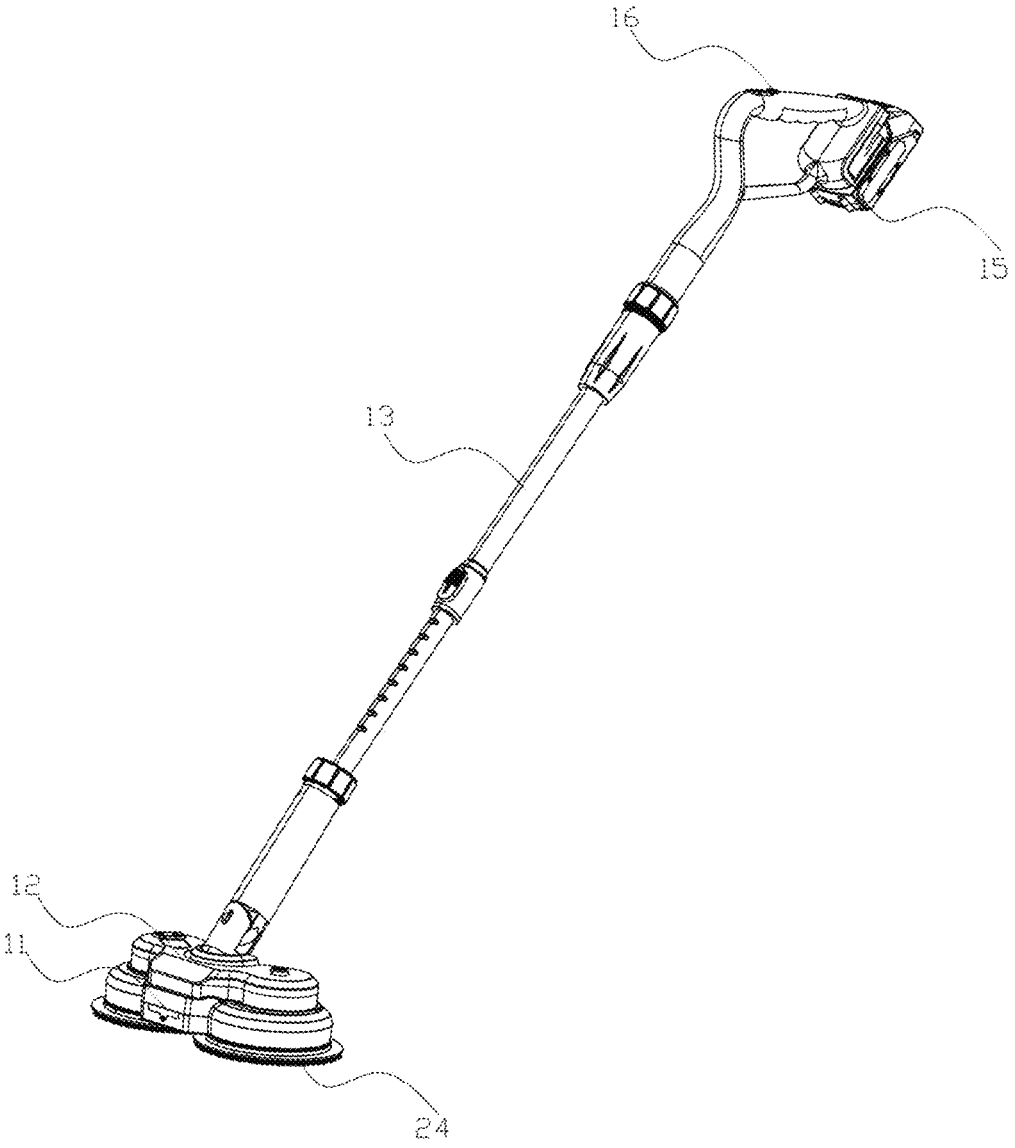
FIG. 9 is a schematic structural diagram of a second embodiment of a multi-functional double-head electric cleaning device according to this disclosure, including a mop assembly.

Referring to FIG. 9, in this embodiment, a multi-functional double-head electric cleaning device 10 of this disclosure includes a power assembly 11, a water tank assembly 12, a connecting rod assembly 13, two mop assemblies 24, a battery assembly 15, and a key assembly 16. The water tank assembly 12 is a hollow cavity and is detachably disposed on the power assembly 11, and the water tank assembly 12 stores cleaning liquid. The connecting rod assembly 13 is movably disposed on the power assembly 11 and can rotate relative to the power assembly 11, thereby facilitating the adjustments of different cleaning angles. The two mop assemblies 24 are detachably connected to the power assembly 11 respectively, and the power assembly 11 synchronously drives the two mop assemblies 24 to rotate, thereby performing mopping operations. The battery assembly 15 is detachably connected to the connecting rod assembly 13, is electrically connected to the power assembly 11, and serves as a power supply to the power assembly 11. The key assembly 16 is disposed on the connecting rod assembly 13 in a penetrating manner, is electrically connected to the power assembly 11, and controls switching and function settings of the power assembly 11.

Figure 10:
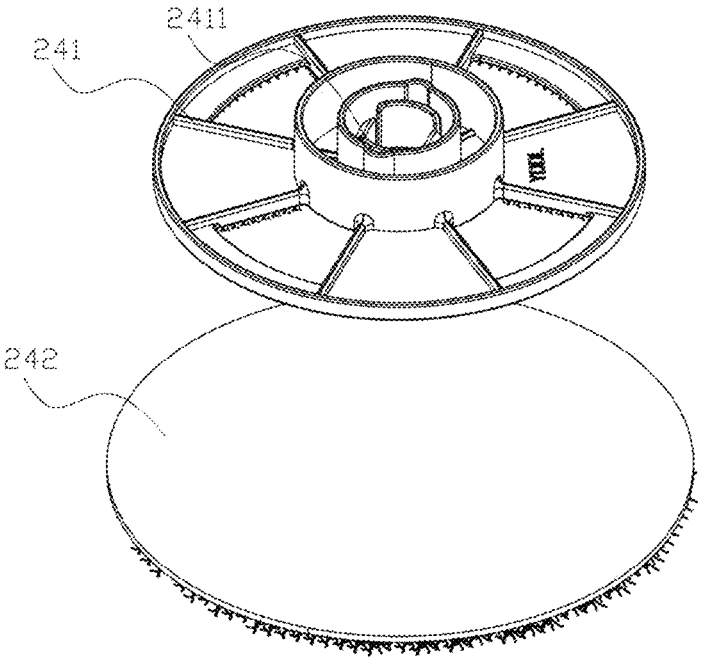
FIG. 10 is a schematic structural exploded view of a mop assembly shown in FIG. 9.

Referring to FIG. 9 and FIG. 10, specifically, the mop assemblies 24 each include a second connecting frame 241 and a mop main body 242. The second connecting frame 241 is detachably connected to a corresponding rotary frame 1135 in a clamped manner and rotates with the rotation of the rotary frame 1135. The mop main body 242 is detachably disposed below the second connecting frame 241, thereby implementing an automatic scrubbing operation through the rotation of the mop main body 242. Specifically, a plurality of second clamping blocks 2411 are disposed on the second connecting frame 241 respectively, and the plurality of second clamping blocks 2411 are detachably disposed in corresponding clamping grooves 11351 in a clamped manner respectively, thereby fixedly connecting the second connecting frame 241 to the rotary frame 1135. The mop main body 242 is detachably connected to the second connecting frame 241 through a hook-and-loop fastener.

It should be noted that a specific working process of the multi-functional double-head electric cleaning device 10 of this disclosure is as follows: according to actual cleaning requirements, the two cleaning brush assemblies 14 or mop assemblies 24 are selected to be fixedly clamped on the corresponding rotary frames 1135, and then the key assembly 16 is pressed to select a corresponding working mode to enable the motor 1131 to start working. The motor 1131 drives the worm 1132 to rotate, the worm 1132 synchronously drives the two small transmission gears 1133 to rotate, the small transmission gears 1133 sequentially drive the corresponding large transmission gears 1134 and rotary frames 1135 to rotate, and the rotary frames 1135 drive the cleaning brush assemblies 14 or mop assemblies 24 fixedly disposed below the rotary frames in a clamped manner to rotate, thereby implementing the scrubbing or mopping operations. When the cleaning liquid needs to be sprayed, the water pump switch 116 is pressed to enable the water pump 114 to start working, so that the cleaning liquid in the water tank assembly 12 is sprayed through the liquid outlet nozzle 122, the water pump 114, and the liquid outlet hole 11111 sequentially. When illumination is needed, the key assembly 16 is pressed to enable the illuminating mechanism 115 to work to perform an illumination operation.

The technical features of the above embodiments can be combined in any way. To simplify the description, not all possible combinations of the technical features in the above embodiments are described. However, as long as there is no contradiction in the combinations of the technical features, all the possible combinations should be considered to fall within the scope of the specification.

The above embodiments only represent several implementations of this disclosure, are specifically described in detail, but should not be construed as limiting the patent scope of this disclosure. It should be noted that for those of ordinary skill in the art, several modifications and improvements can be made without departing from the concept of this disclosure and should all fall within the protection scope of this disclosure. Therefore, the protection scope of this disclosure shall be subject to the appended claims.

What is claimed is:

1. A multi-functional double-head electric cleaning device, comprising:

a power assembly, comprising: a housing, wherein the housing is a hollow cavity; and a circuit board, a driving mechanism, and a water pump that are disposed in the housing respectively, wherein the circuit board is electrically connected to the driving mechanism and the water pump respectively, and the driving mechanism penetrates through the housing;

a water tank assembly, detachably disposed on the housing and communicated with the water pump;

a connecting rod assembly, rotatably disposed on the housing, wherein the connecting rod assembly can rotate relative to the housing; and two cleaning assemblies, detachably connected to the corresponding driving mechanism respectively, wherein the driving mechanism comprises: a motor disposed in the housing; a worm fixedly disposed on a rotating shaft of the motor; two small transmission gears disposed on two opposite sides of the worm respectively and in transmission connection with the worm respectively; two large transmission gears in engaging transmission connection with the two small transmission gears respectively; and two rotary frames fixedly connected to the two large transmission gears respectively;

the water tank assembly is provided with a liquid injection opening, and a sealing cover is detachably disposed on the liquid injection opening; and a bottom of the water tank assembly is provided with a liquid outlet nozzle, and the liquid outlet nozzle is communicated with the water pump, wherein the cover plate is provided with at least one positioning column, the water tank assembly is provided with at least one positioning hole, and the positioning hole is matched with the corresponding positioning column, so that the water tank assembly is detachably disposed on the housing in a limited manner, the multi-functional double-head electric cleaning device further comprises a water pump switch, the water pump switch is positioned on the positioning column and penetrates through the positioning hole of the water tank assembly, and the water pump switch is electrically connected to the circuit board, wherein the connecting rod assembly comprises a movable rod mechanism, a telescopic rod mechanism, and a handle that are sequentially disposed, and the movable rod mechanism is rotatably disposed on the housing, and the multi-functional double-head electric cleaning device further comprises a battery assembly, the battery assembly is detachably connected to the handle and connected to the circuit board.

2. The multi-functional double-head electric cleaning device according to claim 1, wherein the cleaning assemblies comprise cleaning brush assemblies and mop assemblies.

3. The multi-functional double-head electric cleaning device according to claim 2, wherein the cleaning brush assemblies each comprise a first connecting frame and a cleaning brush main body fixedly disposed below the first connecting frame, and the first connecting frame is detachably connected to the rotary frame in a clamped manner.

4. The multi-functional double-head electric cleaning device according to claim 3, wherein a plurality of first clamping blocks are disposed on the first connecting frame respectively, and the plurality of first clamping blocks are detachably disposed in corresponding clamping grooves on the rotary frame in a clamped manner respectively.

5. The multi-functional double-head electric cleaning device according to claim 2, wherein the mop assemblies each comprise: a second connecting frame detachably connected to the driving mechanism in a clamped manner; and a mop main body detachably disposed below the second connecting frame.

6. The multi-functional double-head electric cleaning device according to claim 5, wherein a plurality of second clamping blocks are disposed on the second connecting frame respectively, and the plurality of second clamping blocks are detachably disposed in corresponding clamping grooves on the rotary frame in a clamped manner respectively.

7. The multi-functional double-head electric cleaning device according to claim 1, wherein the housing comprises: a main housing, which is a hollow cavity with an opening at one end; and a cover plate fixedly disposed on the main housing, wherein the main housing and the cover plate form a closed cavity.

8. The multi-functional double-head electric cleaning device according to claim 7, wherein a side edge of the main housing is provided with a liquid outlet hole in a penetrating manner, and the liquid outlet hole is communicated with a liquid outlet end of the water pump through a connecting water pipe.

9. The multi-functional double-head electric cleaning device according to claim 8, wherein the cover plate is provided with a liquid inlet hole in a penetrating manner, one end of the liquid inlet hole is communicated with the water tank assembly in a sealing contact manner, and the other end thereof is communicated with a liquid inlet end of the water pump through the connecting water pipe.

10. The multi-functional double-head electric cleaning device according to claim 1, wherein the movable rod mechanism comprises: a connecting head fixedly disposed on the housing; a movable head rotatably disposed on the connecting head through a rotary shaft; a movable rod rotatably connected to the movable head and fixedly connected to the telescopic rod mechanism; and a clamping pin movably disposed in the movable head in a penetrating manner, which can be connected to the movable rod in a clamped manner.

11. The multi-functional double-head electric cleaning device according to claim 10, wherein the telescopic rod mechanism comprises: a first telescopic rod fixedly connected to the movable rod; and a second telescopic rod sleeved on the first telescopic rod, which can be connected to the first telescopic rod in a clamped manner.

12. The multi-functional double-head electric cleaning device according to claim 1, further comprising a key assembly, wherein the key assembly is disposed on the connecting rod assembly in a penetrating manner and is connected to the circuit board.

13. The multi-functional double-head electric cleaning device according to claim 1, further comprising an illuminating mechanism, wherein the illuminating mechanism is fixedly disposed in the housing and is electrically connected to the circuit board, and light emitted by the illuminating mechanism can be transmitted out of the housing.

* * * * *